United States Patent [19]

Okumura

[11] 4,437,379

[45] Mar. 20, 1984

[54] ELECTRONIC MUSICAL INSTRUMENT OF WAVEFORM MEMORY READOUT TYPE

[75] Inventor: Takatoshi Okumura, Hamamatsu, Japan

[73] Assignee: Nippon Gakki Seizo Kabushiki Kaisha, Hamamatsu, Japan

[21] Appl. No.: 315,110

[22] Filed: Oct. 26, 1981

[30] Foreign Application Priority Data

Nov. 29, 1980 [JP] Japan ..... 55-168442

[51] Int. Cl.[3] ..... G10H 1/06

[52] U.S. Cl. ..... 84/1.22; 84/1.01

[58] Field of Search ..... 84/1.01, 1.19, 1.22, 84/1.23

[56] References Cited

U.S. PATENT DOCUMENTS

| | | | |
|---|---|---|---|
| 3,515,792 | 6/1970 | Deutsch | 84/1.03 |
| 4,213,366 | 7/1980 | Mimi et al. | 84/1.01 |
| 4,224,856 | 9/1980 | Ando et al. | 84/1.19 |
| 4,227,435 | 10/1980 | Ando et al. | 84/1.19 |

*Primary Examiner*—F. W. Isen

*Attorney, Agent, or Firm*—Remy J. VanOphem

[57] ABSTRACT

Keys of a keyboard are divided into a plurality of tone ranges and a plurality of musical tone waveforms regarding specific ones of the divided tone ranges are stored in a waveform memory device. A number of the plurality of musical tone waveforms is smaller than the number of the divided tone ranges. An address signal generator is provided which generates an address signal having a repetition period corresponding to a tone pitch of a depressed key and supplies the address signal to the waveform memory device, and an arithmetic operating circuit is provided which selects ones from among the plurality of musical tone waveforms and mixes the selected ones of a mixing ratio, thereby forming a new musical tone waveform. The selected ones and the mixing ratio are predetermined corresponding to each of the tone ranges. Different tone colors of a number which is more than the number of the waveforms are realized for the respective tone ranges just like in a natural musical instrument.

3 Claims, 2 Drawing Figures

ELECTRONIC MUSICAL INSTRUMENT OF WAVEFORM MEMORY READOUT TYPE

BACKGROUND OF THE INVENTION

This invention relates to an electronic musical instrument, and more particularly to an improvement of an electronic musical instrument of the waveform memory device readout type.

An electronic musical instrument of the waveform memory readout type has been known wherein a musical waveform prestored in a waveform memory device is read out according to an address signal corresponding to the tone pitch of a depressed key to produce a musical tone.

With the electronic musical instrument of the waveform memory readout type, once the waveform to be stored in the waveform memory device is determined, the tone color of the produced musical tone is the same for all tone ranges so that the tone color of the musical tone is respective tone ranges does not change as in a natural musical instrument in which harmonics are abundant in a low tone range while the harmonics are less in a high tone range.

To obviate this difficulty it has been proposed to provide an electronic musical instrument in which a keyboard is divided into a plurality of tone ranges and waveform memory devices are provided for respective tone ranges so as to produce musical tone waveforms having different waveforms in respective tone ranges, as described in U.S. Pat. No. 4,213,366.

In this electronic musical instrument, however, it is necessary to provide waveform memory devices of the same number as the number of the divided tone ranges with the result that the size of the electronic musical instrument becomes large and its manufacturing cost increases.

SUMMARY OF THE INVENTION

Accordingly, it is an object of this invention to provide an improved electronic musical instrument having a simple construction but capable of producing musical tones of different tone colors in respective tone ranges just like a natural musical instrument.

The present invention provide an electronic musical instrument having a keyboard including a plurality of keys which are divided into a plurality of tone ranges. A plurality of waveform memory devices of a number smaller than the number of the divided tone ranges are provided the waveform corresponding to memory devices storing musical tone waveforms specific ones of the divided tone ranges. An address signal generator is provided which, in response to a signal representing a tone pitch of a depressed key, forms an address signal having a repetition period corresponding to the tone pitch. The signal generator applies the address signal to the waveform memory and arithmetic operating means which selects two musical tone waveforms corresponding to a tone range of a depressed key among musical tone waveforms read out from the waveform memory devices by the address signal and interpolates in order to form a musical tone waveform corresponding to the tone range of the depressed key by utilizing the two musical tone waveforms selected according to the tone range of the depressed key.

DESCRIPTION OF THE PREFERRED EMBODIMENTS

Figure 1:
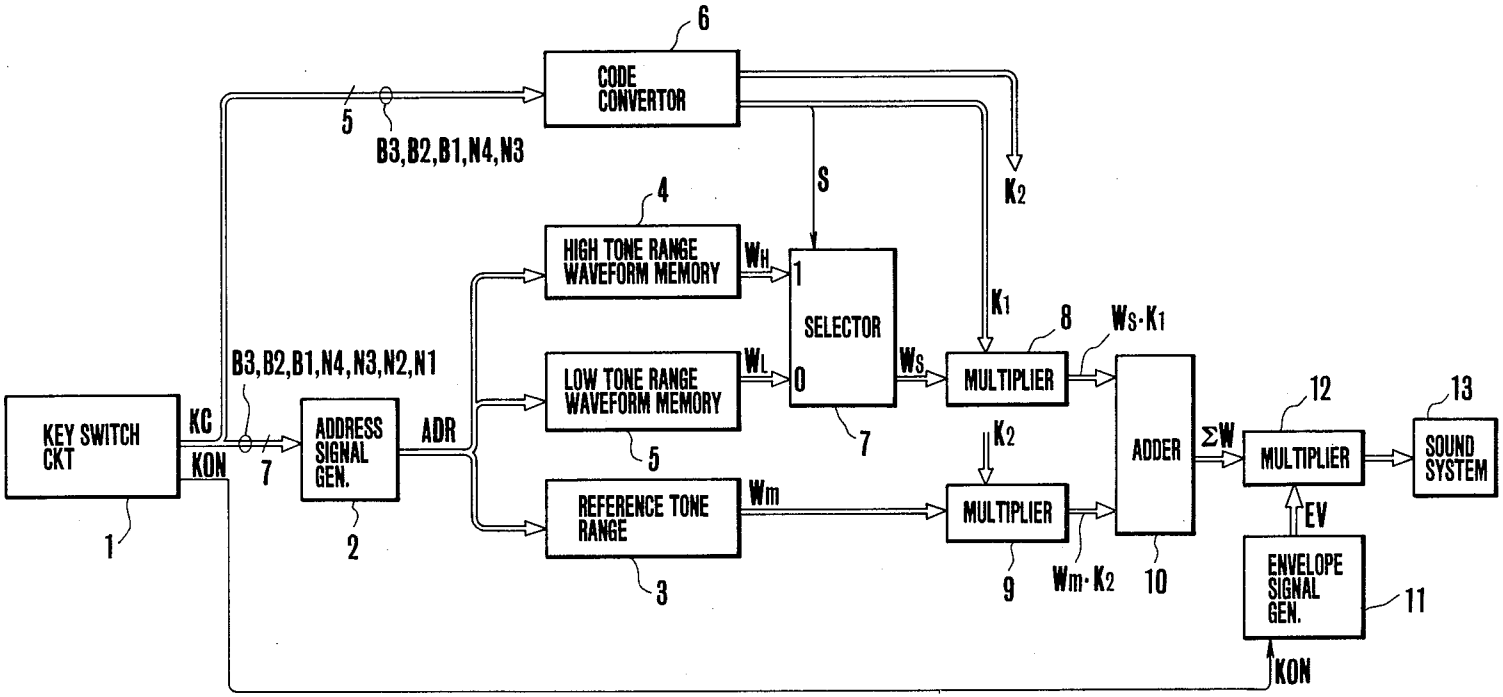
FIG. 1 is a block diagram showing an embodiment of the electronic musical instrument according to this invention.

The electronic musical instrument shown in FIG. 1 has a total of 49 keys, not shown, ranging from a note C2 to C6. In this example, the tone ranges are divided into 17 ranges each including three keys as shown in the following Table I (provided that a tone range for note C6 includes only one key). Among these 17 tone ranges, a tone range to which keys of note C4 through D4 belong is termed a reference tone range, a tone range to which a key of the note C6 belongs is termed a high tone range, and a tone range to which keys of notes C2 through D2 belong is termed a low tone range. According to this invention, a reference tone range waveform memory device, a high tone range waveform memory device and a low tone range waveform memory device are provided only for these three tone ranges, the memory devices prestoring musical tone waveforms regarding the tone ranges. Furthermore, the musical tone waveforms for the other tone ranges are produced by interpolating the musical tone waveforms read out from the three waveform memory devices in accordance with a specific tone range to which a depressed key belongs. In Table I, a signal S and constants $K_1$ and $K_2$ are used for interpolation.

TABLE I

| Tone range | Signals S | Constant $K_1$ | Constant $K_2$ |
|---|---|---|---|
| C6 | 1 | 1 | 0 |
| A5 to B5 | 1 | 7/8 | 1/8 |
| F#5 to G#5 | 1 | 6/8 | 2/8 |
| D#5 to F5 | 1 | 5/8 | 3/8 |
| C5 to D5 | 1 | 4/8 | 4/8 |
| A4 to B4 | 1 | 3/8 | 5/8 |
| F#4 to G#4 | 1 | 2/8 | 6/8 |
| D#4 to F4 | 1 | 1/8 | 7/8 |
| C4 to D4 | 1/0 | 0 | 1 |
| A3 to B3 | 0 | 1/8 | 7/8 |
| F#3 to G#3 | 0 | 2/8 | 6/8 |
| D#3 to F3 | 0 | 3/8 | 5/8 |
| C3 to D3 | 0 | 4/8 | 4/8 |
| A2 to B2 | 0 | 5/8 | 3/8 |
| F#2 to G#2 | 0 | 6/8 | 2/8 |
| D#2 to F2 | 0 | 7/8 | 1/8 |
| C2 to D2 | 0 | 1 | 0 |

As shown in FIG. 1 there is provided a key switch circuit 1 which includes a plurality of key switches corresponding to respective keys of the keyboard, such that when a key is depressed, a key switch corresponding thereto operates to generate and output key codes KC, as shown in the following Tables IIa and IIb based on an output signal produced by the key switch. Each key code is a seven bit signal consisting of block codes BC (B3, B2 and B1) representing an octave tone range of the key and note codes NC (N4, N3, N2 and N1). The key switch circuit 1 also produces a key-on signal KON representing that a key has been depressed.

TABLE IIa

| Octave | Block code BC | | |
|---|---|---|---|
| | B3 | B2 | B1 |
| C2 to B2 | 0 | 0 | 1 |
| C3 to B3 | 0 | 1 | 0 |
| C4 to B4 | 0 | 1 | 1 |
| C5 to B5 | 1 | 0 | 0 |
| C6 | 1 | 0 | 1 |

TABLE IIb

| Note | Note code NC | | | |
|---|---|---|---|---|
| | N4 | N3 | N2 | N1 |
| C | 0 | 0 | 0 | 0 |
| C# | 0 | 0 | 0 | 1 |
| D | 0 | 0 | 1 | 0 |
| D# | 0 | 1 | 0 | 0 |
| E | 0 | 1 | 0 | 1 |
| F | 0 | 1 | 1 | 0 |
| F# | 1 | 0 | 0 | 0 |
| G | 1 | 0 | 0 | 1 |
| G# | 1 | 0 | 1 | 0 |
| A | 1 | 1 | 0 | 0 |
| A# | 1 | 1 | 0 | 1 |
| B | 1 | 1 | 1 | 1 |

There is also provided an address signal generator 2 which, in response to a key code KC outputted from the key switch circuit 1, generates and outputs an address signal ADR having a repetition period corresponding to the note of the depressed key. The address signal generator 2 is constructed such that it reads out frequency information F corresponding to the note of the depressed key from the memory device, and that is repeatedly accumulates the frequency information F at a predetermined speed to output the accumulated value qF (q=1, 2, . . . ) as the address signal.

There is also provided a reference tone range waveform memory device 3 storing a musical tone waveform corresponding to tone range to which the keys of notes C4 through D4 belong, a high tone range waveform memory device 4 storing a musical tone waveform regarding a tone range to which the key of note C6 belongs, and a low tone range waveform memory device 5 storing a musical tone waveform corresponding to a tone range to which keys of the notes C2 through D2 belong. When supplied with an address signal outputted from the address signal generator 2, these waveform memory devices 3, 4 and 5 produce stored waveform signals $W_m$, $W_H$ and $W_L$ respectively. In this embodiment, in the high tone range memory device 4 is stored a musical tone waveform containing less number of harmonic components, whereas in the low tone range waveform memory device 5 is stored a musical tone waveform containing a large number of harmonic components.

A code converter 6 is provided which receives five bit signals B3, B2, B1, N4 and N3 among a seven bit key code KC for judging a tone range to which the depressed key belongs, the signal S and the constant $K_1$ and $K_2$ shown in Table I. There is further provided a selector 7 which selects the high tone range waveform memory device 4 and outputs the musical tone waveform $W_H$ when the signal S outputted from the code converter 6 is "1" whereas selects the low tone range waveform memory device 5 and outputs the musical tone waveform $W_L$ when the signal S is "0"; a multiplier 8 which multiplies the output waveform $W_S$ and the constant $K_1$; a multiplier 9 which multiplies the musical tone waveform $W_m$ outputted from the reference tone range waveform memory device 3 with the constant $K_2$; an adder 10 which adds the output waveform $(W_S)\times(K_1)$ of the multiplier 8 to the output waveform $(W_m)\times(K_2)$ of the multiplier 9; an envelope signal generator 11 which starts its operation in synchronism with the building up of the key-on signal KON outputted from the key switch circuit for producing an envelope signal EV imparting an amplitude envelope to a musical tone waveform to be produced; a multiplier 12 for multiplying the output waveform $\Sigma W[=(W_m)\times(K_2)+(W_S)\times(K_1)]$ outputted from the adder 10 with the envelope signal EV; and a sound system 13 which converts the output waveform signal $(EV)\times(\Sigma W)$ of the multiplier 12 into a musical tone signal.

Where a key of the note C4, for example, is depressed, the key switch circuit 1 produces a key code KC as shown in the following Table III.

TABLE III

| Key code KC | | | | | | |
|---|---|---|---|---|---|---|
| B3 | B2 | B1 | N4 | N3 | N2 | N1 |
| 0 | 1 | 1 | 0 | 0 | 0 | 0 |

Then, in accordance with this key code KC, the address signal generator 2 forms an address signal ADR having a repetition period corresponding to the note C4 and applies this address signal ADR in parallel to the reference tone range waveform memory device 3, the high tone range waveform memory device 4 and the low tone range waveform memory device 5. Then, these three waveform memory devices 3, 4 and 5 produce musical tone waveforms $W_m$, $W_H$ and $W_L$ respectively prestored therein in response to the address signal ADR. In this case, the frequencies of the musical tone waveforms $W_m$, $W_H$ and $W_L$ correspond to the repetition period of the address signal ADR, in other words, to the note C4.

Only the bit signals B3, B2, B1, N4 and N3 of the key code KC are inputted to the code converter 6, whereby it produces a signal S having the value "1" (or "0"), a constant $K_1=0$ and a constant $K_2=1$.

Then the selector 7 selects a musical tone waveform $W_H$(or $W_L$) corresponding to the high tone range (or the low tone range) and supplies the selected waveform $W_H$(or $W_L$) to the multiplier 8. In this case, however, as the multiplier 8 is supplied with the constant $K_1=0$, the amplitude value of the output waveform $(W_S)\times(K_1)$ of the multiplier 8 has the value "0".

On the other hand, since the multiplier 9 is inputted with the constant $K_2=1$, it produces a musical tone waveform $(W_m)\times(K_2)$ having an amplitude value expressed by an equation $$(W_m)\times(K_2)=(W_m)\times 1$$

This musical tone waveform $(W_m)\times(K_2)$ is applied to one input of the adder 10, whereas the musical tone waveform $(W_S)\times(K_1)$ is applied to the other input of the adder 10. Consequently, the adder 10 produces a musical tone waveform $W_m$ corresponding to the reference tone range as a synthesized musical tone waveform $\Sigma W$. This synthesized musical tone waveform $\Sigma W$ is inputted to the multiplier 12 to be multiplied with the envelope signal EV, thus setting an amplitude value of the envelope signal. Consequently, the sound system 13 produces a musical tone corresponding to the note C4.

As above described, where a depressed key belongs to the reference tone range of the notes C4 through D4, a musical tone would be produced based only upon the output musical tone waveform $W_m$ of the waveform memory device 3 in which has been previously stored a musical tone waveform corresponding to the reference tone range.

Suppose now that a key of the note C6 is depressed, the key switch circuit 1 would produce a key code KC as shown in the following Table IV.

TABLE IV

| Key code KC | | | | | | |
|---|---|---|---|---|---|---|
| B3 | B2 | B1 | N4 | N3 | N2 | N1 |
| 1 | 0 | 1 | 0 | 0 | 0 | 0 |

Then the address signal generator 2 supplies an address signal ADR in parallel to the three waveform memory devices 3, 4 and 5. The address signal ADR has a repetition frequency corresponding to the note C6. For this reason, the three waveform memory devices 3, 4 and 5, respectively, produce musical tone waveforms $W_m$, $W_H$ and $W_L$ corresponding to the note C6.

Since the depressed key is in a tone range of the note C6, the code converter 6 produces a signal S having a value "1" and constants $K_1=1$ and $K_2=0$. As a consequence, the selector 7 selects a musical tone waveform $W_H$ corresponding to the hight tone range and supplies the selected musical tone waveform $W_H$ to the multiplier 8. Since the multiplier 8 is supplied with the constant $K_1=1$, it produces a musical tone waveform $(W_S)\times(K_1)$ having an amplitude value expressed by an equation $$(W_S)\times(K_1)=(W_S)\times 1$$

On the other hand, since the constant $K_2$ is equal to "0", the multiplier 9 produces an output waveform $(W_m)\times(K_2)$ having an amplitude value of "0". Consequently, as a synthesized musical tone waveform $\Sigma W$, the adder 10 produces a musical tone waveform containing only the musical tone waveform $W_H$ corresponding to the high tone range. Accordingly, where the depressed key belongs to the high tone range of the note C6, the musical tone would be produced only by the musical tone waveform $W_H$ outputted from the high tone waveform memory device 4 corresponding to the high tone range.

The operations are also performed where the depressed key belongs to the low tone range including the notes C2 through D2. More particularly, where the depressed key belongs to the low tone range, since the signal S has the value "0" (see Table I), the selector 7 selects and outputs a musical tone waveform $W_L$ corresponding to the low tone range. At this time, constants $K_1=1$ and $K_2=0$. Accordingly, the amplitude value of the waveform $(W_S)\times(K_1)$ of the multiplier 8 becomes $(W_L)\times 1$, while the amplitude value of the waveform $(W_m)\times(K_2)$ outputted from the multiplier 9 becomes "0". Consequently, the synthesized musical tone waveform $\Sigma W$ outputted from the adder 10 contains only the musical tone waveform $W_L$ corresponding to the low tone range.

Suppose now that a key of the note F3, for example, is depressed. Then the address signal generator 2 supplies to the three waveform memory devices 3, 4 and 5 an address signal ADR having a repetition period corresponding to the note F3 so as to cause them to produce musical tone waveforms $W_m$, $W_H$ and $W_L$ having frequencies corresponding to the note F3. However, since the depressed key belongs to a tone range to which keys of the notes D#3 through F3 belong, the code converter 6 produces a signal S having the value "0", a constant $K_1=\frac{3}{8}$, and a constant $K_2=\frac{1}{8}$, as can be clearly noted from Table I. For this reason, the selector 7 selects a musical tone waveform $W_L$ corresponding to the low tone range and supplies it to the multiplier 8. Then, this multiplier outputs a musical tone waveform $(W_S)\times(K_1)$ having an amplitude value expressed by an equation $$(W_S)\times(K_1)=W_L\times(\tfrac{3}{8})$$

because the constant $K_1$ is equal to $\frac{3}{8}$.

On the other hand, since the constant $K_2=\frac{5}{8}$, the multiplier 9 produces a musical tone waveform $W_m$ $K_2$ having an amplitude value expressed by an equation $$(W_m)\times(K_2)=W_m\times(\tfrac{5}{8})$$

These two musical tone waveforms $(W_S)\times(K_1)$ and $(W_m)\times(K_2)$ are added together or synthesized by the adder 10. Thus, the adder 10 produces a synthesized musical tone waveform W whose amplitude value is expressed by an equation $$\Sigma W=[(W_L)\times(\tfrac{3}{8})]+[(W_m)\times(\tfrac{5}{8})]$$

More particularly, where the depressed key belongs to a note range of from D#3 to F3, in other words, when the depressed key belongs to an intermediate tone range between the reference tone range (C4 through D4) and the low tone range (C2 through D2), the adder 10 produces two musical tone waveforms $(W_S)\times(K_1)$ and $(W_m)\times(K_2)$ such that the amplitudes of the musical tone waveforms $W_m$ and $W_L$ outputted from the reference tone range waveform memory device 3 and the low tone range waveform memory device 5, respectively, are controlled by complementary constants $K_1$ and $K_2$ corresponding to the notes of the depressed keys. Accordingly, the musical tone waveform finally outputted would contain the musical tone waveform $W_m$ corresponding to the reference tone range, and the musical tone waveform $W_L$ corresponding to the low tone range at a ratio of 5:3, thereby producing a musical tone having a tone color similar to that of a natural musical instrument. This is also true for other tone ranges.

As described above, this embodiment enables production of musical tone waveforms having different waveforms in a total of seventeen tone ranges with only three waveform memory devices and an arithmetic operation unit that interpolates by utilizing the outputs of these waveform memory devices based on the notes of the depressed keys, thus producing a musical tone having different tone colors in respective tone ranges in a manner similar to a natural musical instrument.

Figure 2:
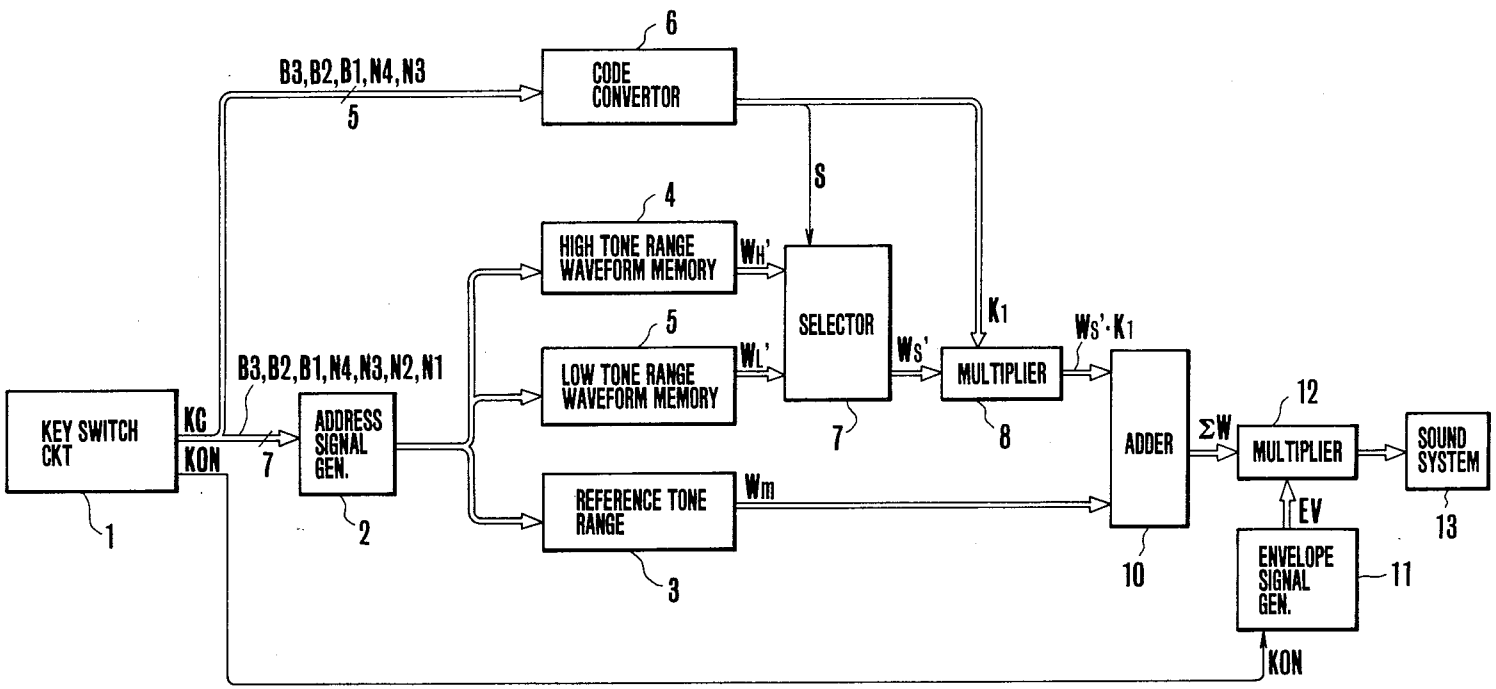
FIG. 2 is a block diagram showing another embodiment of the electronic musical instrument.

FIG. 2 shows a modified embodiment of the present invention which is similar to the embodiment shown in FIG. 1 except as described below.

In the modified embodiments, the musical tone waveform $W_m$ the note range C4 through D4 and to be stored in the reference tone corresponding to range memory device 3 is the same as in the embodiment shown in FIG. 1. The musical tone waveforms $W_H'$ and $W_L'$ in the modified embodiment a note range covering notes C6, C2 to D2 and to be respectively corresponding to stored in the high tone range waveform memory device 4 and the low tone range waveform memory device 5 are different from those in the first embodiment and are expressed by the following equations.

$$W_H' = (W_H - W_m) \times (\tfrac{1}{8})$$

$$W_L' = (W_L - W_m) \times (\tfrac{1}{8})$$

Consequently, the code converter 6 is constructed to produce a signal S and a constant $K_1$ as shown in the following Table V.

The circuit construction is modified as shown in FIG. 2 such that the output $W_m$ of the reference tone range waveform memory device 3 is directly applied to the adder 10.

TABLE V

| Tone range | Signal S | Constant K |
|---|---|---|
| C6 | 1 | 8 |
| A5 to B5 | 1 | 7 |
| F#5 to G#5 | 1 | 6 |
| D#5 to F5 | 1 | 5 |
| C5 to D5 | 1 | 4 |
| A4 to B4 | 1 | 3 |
| F#4 to G#4 | 1 | 2 |
| D#4 to F4 | 1 | 1 |
| C4 to D4 | 1/0 | 0 |
| A3 to B3 | 0 | 1 |
| F#3 to G#3 | 0 | 2 |
| D#3 to F3 | 0 | 3 |
| C3 to D3 | 0 | 4 |
| A2 to B2 | 0 | 5 |
| F#2 to G#2 | 0 | 6 |
| D#2 to F2 | 0 | 7 |
| C2 to D2 | 0 | 8 |

Thus, with this modification, when a key of the note C6 is depressed, the adder 10 produces a musical tone waveform ΣW expressed by an equation $$\Sigma W = W_m + (W_S') \times (K_1) = W_m + 8 \times (W_H - W_m)/8 = W_H.$$

When a key belonging to a tone range C2 through D2 is depressed the output musical tone waveform ΣW of the adder 10 is expressed by the following equation.

$$\Sigma W = W_m + (W_S') \times (K_1) = W_m + 8 \times (W_L - W_m)/8 = W_L.$$

When a key belonging to a tone range D#3 through F3 is depressed the musical tone waveform ΣW outputted from the adder 10 is expressed by the following equation $$\Sigma W = W_m + (W_S') \times (K_1) = W_m + 3 \times (W_L - W_m)/8 = (\tfrac{5}{8}) \times (W_m) + (\tfrac{3}{8}) \times (W_L).$$

Thus, in the same manner as in the example shown in FIG. 1, it is possible to obtain a musical tone signal having waveforms which differ according to the tone range.

As described above, by storing in the waveform memory devices musical tone waveforms corresponding to high and low tone ranges by taking into consideration the difference in the amplitude values of these musical tone waveforms and of the musical tone waveform corresponding to the reference tone range, the capacities of the memory devices can be reduced more or less than that of the example shown in FIG. 1.

In the foregoing examples, the constants $K_1$ and $K_2$ that control the ratio of interpolation are set to change with three key units. However, when they are set to change with a single key unit, a more advantageous effect can be obtained. Furthermore, while in the foregoing example the tone range of the keyboard was divided with three key units, the keyboard can be divided with units including any desired number of keys.

Instead of providing three waveform memory devices, two memory devices can be used, one for the high tone range and the other for the low tone range.

As can be noted from the foregoing description of the present invention, it is possible to produce a musical tone having different tone colors for tone ranges to which depressed keys belong.

What is claimed is:

1. An electronic musical instrument comprising:

keyboard means having a plurality of keys which are divided into a plurality of tone ranges, each of said tone ranges including one or more adjacent keys respectively;

memory means for storing at least two waveforms of a number smaller than the number of said tone ranges, one of said stored waveforms being a reference waveform which is a musical tone waveform corresponding to a specific one among said tone ranges and a second of said at least two stored waveforms being a difference waveform whose waveshape is the difference between said reference waveform and a waveform which is a musical tone waveform corresponding to a highest tone range among said tone ranges divided by a factor proportional to the numerical difference between said specific one tone range and said highest tone range;

address signal generating means for generating an address signal having a repetition period corresponding to a tone pitch of a depressed key and for supplying said address signal to said memory means so that said reference waveform and said difference waveform respectively having the periods equal to said repetition period are read out from said memory means;

coefficient generator means for producing a coefficient having a value proportional to the numerical difference between said specific one tone range and the tone range corresponding to said depressed key;

multiplier means for multiplying said difference waveform by said coefficient to generate a modified waveform; and means for adding said modified waveform to said reference waveform to produce a musical tone waveform corresponding to said depressed key.

2. An electronic musical instrument comprising:

keyboard means having a plurality of keys which are divided into a plurality of tone ranges, each of said tone ranges including one or more adjacent keys respectively;

memory means for storing at least two waveforms of a number smaller than the number of said tone ranges, one of said stored waveforms being a reference waveform which is a musical tone waveform corresponding to a specific one among said tone ranges and a second of said at least two stored waveforms being a difference waveform whose waveshape is the difference between said reference waveform and a waveform which is a musical tone waveform corresponding to a lowest tone range among said tone ranges divided by a factor proportional to the numerical difference between said specific one tone range and said lowest tone range;

address signal generating means for generating an address signal having a repetition period corresponding to a tone pitch of a depressed key and for supplying said address signal to said memory means so that said reference waveform and said difference waveform respectively having periods equal to said repetition period are read out from said memory means;

coefficient generator means for producing a coefficient having a value proportional to the numerical difference between said specific one tone range and the tone range corresponding to said depressed key;

multiplier means for multiplying said difference waveform with said coefficient to generate a modified waveform; and means for adding said modified waveform with said reference waveform to form a musical tone waveform corresponding to said depressed key.

3. An electronic musical instrument comprising:

keyboard means having a plurality of keys which are divided into a plurality of tone ranges, each of said tone ranges including one or more adjacent keys respectively;

memory means for storing at least three waveforms of a number smaller than the number of said tone ranges, one of said stored waveforms being a reference waveform which is a musical tone waveform corresponding to a specific one among said tone ranges intermediate the highest and lowest tone ranges of said plurality of tone ranges, a second of said waveforms being a first difference waveform whose waveshape is the difference between said reference waveform and a waveform which is a musical tone waveform corresponding to the highest tone range among said tone ranges, divided by a factor proportional to the numerical difference between said specific one tone range and said highest tone range and a third of said at least three waveforms being a second difference waveform whose waveshape is determined by the difference between said reference waveform and a waveform which is a musical tone waveform corresponding to a lowest tone range among said tone ranges divided by a factor proportional to the numerical difference between said specific one tone range and said lowest tone range;

address signal generating means for generating an address signal having a repetition period corresponding to a tone pitch of a depressed key and for supplying said address signal to said memory means so that said reference waveform, said first difference waveform and said second difference waveform respectively having periods equal to said repetition period are read out from said memory means;

converter means for generating a selector signal indicating that the tone range of said depressed key is above or below said specific one tone range and for generating a multiplier coefficient having a value proportional to the numerical difference between the tone range of said depressed key and said specific one tone range;

selector means connected to said memory means for outputting said first difference waveform in response to said selector signal indicating the tone range of said depressed key is above said selected one tone range and for outputting said second difference waveform in response to said selector signal indicating that the tone range of said depressed key is below the tone range of said selected one tone range;

multiplier means connected to said selector means for multiplying said first and second difference signals output from said selector means by said multiplier coefficient to generate a modified difference waveform; and adder means for adding said modified difference waveform to said reference waveform to generate a musical tone waveform corresponding to said depressed key.

* * * * *

UNITED STATES PATENT AND TRADEMARK OFFICE

CERTIFICATE OF CORRECTION

PATENT NO. : 4,437,379

DATED : March 20, 1984

INVENTOR(S) : Takatoshi Okumura

It is certified that error appears in the above-identified patent and that said Letters Patent is hereby corrected as shown below:

Column 1, Line 22, delete "is" and insert ---- in ----.

Column 1, line 52, after "provided" insert a comma ---- , ----.

Same line, delete "corresponding to".

Column 1, line 53, after "waveforms" insert ---- corresponding to ----.

Column 2, line 59, delete the comma ",".

Column 2, line 61, after "IIb" insert a comma ---- , ----.

Column 6, line 6, delete "$K_2$=1/8" and insert ---- $K_2$-5/8 -----.

Column 6, line 64, after "$W_m$" insert ---- corresponding to ----.

Column 6, line 68, after "embodiment" insert ---- corresponding to ----.

UNITED STATES PATENT AND TRADEMARK OFFICE

CERTIFICATE OF CORRECTION

PATENT NO. : 4,437,379

DATED : March 20, 1984

INVENTOR(S) : Takatoshi Okumura

It is certified that error appears in the above-identified patent and that said Letters Patent is hereby corrected as shown below:

Column 7, line 1, delete "correspond-".

Column 7, line 2, delete "ing to".

In the Abstract

Title page, Line 13, delete "of" and insert ---- at ----.

Signed and Sealed this

Second Day of April 1985

[SEAL]

*Attest:*

DONALD J. QUIGG

*Attesting Officer* *Acting Commissioner of Patents and Trademarks*